US005890541A

United States Patent [19]

Jennings et al.

[11] Patent Number: 5,890,541

[45] Date of Patent: Apr. 6, 1999

[54] BOP ISOLATION TEST TOOL

[75] Inventors: Charles E. Jennings; Richard W. Slyker, both of Houston, Tex.

[73] Assignee: ABB Vetco Gray Inc., Houston, Tex.

[21] Appl. No.: 812,553

[22] Filed: Mar. 7, 1997

[51] Int. Cl.[6] ..... E21B 41/00

[52] U.S. Cl. ..... 166/336; 166/250.08; 166/330

[58] Field of Search ..... 166/336, 337, 166/250.08, 330, 238, 332.3

[56] References Cited

U.S. PATENT DOCUMENTS

| | | | |
|---|---|---|---|
| 4,018,276 | 4/1977 | Bede | 166/250.08 |
| 4,090,395 | 5/1978 | Dixon et al. | 166/250.08 |
| 4,230,185 | 10/1980 | Fredd | 166/332.3 |
| 4,554,976 | 11/1985 | Hynes et al. | 166/337 |
| 4,881,598 | 11/1989 | Stockinger et al. | 166/337 |

*Primary Examiner*—William Neuder
*Attorney, Agent, or Firm*—James E. Bradley

[57] ABSTRACT

A test tool having a body, a mandrel, a ball valve with an actuating mechanism and a bore is lowered on a string of drill pipe and landed in a wellhead housing. A retainer ring with internal threads is carried by the mandrel and engages threads on the body. The retainer ring has a slot which is engaged by a tab on the mandrel, causing the retainer ring and the mandrel to rotate together. The ball valve engages a drive plate which couples with a clutch so that the drive plate may rotate relative to the clutch. A rocker arm engages the drive plate and the mandrel to open and close the ball valve in response to rotation of the mandrel. The test tool is lowered through a riser into a wellhead on pipe below a blowout preventer. The blowout preventer closes around the pipe to form a seal and fluid is pumped down a line to test the blowout preventer. After this test, rotation of the mandrel closes the ball valve automatically. As the mandrel rotates, the retainer ring disengages the body, so that the mandrel and the pipe may be lifted above the BOP. The blowout preventer is moved to a fully closed position and fluid is once again pumped down to test the blowout preventer.

21 Claims, 10 Drawing Sheets

BOP ISOLATION TEST TOOL

TECHNICAL FIELD

This invention relates in general to subsea well tools and in particular to a tool that will seal in the bore of a wellhead for testing a blowout preventer located above.

BACKGROUND ART

In one type of offshore drilling, a subsea wellhead will be installed at the sea floor. A riser will connect to the wellhead and extend upward to a drilling vessel floating at the surface. A blowout preventer stack, hereinafter referred to as a BOP, will be located within the riser.

It is a good practice to test a BOP by closing the BOP on drill pipe and applying pressure below the drill pipe. In addition, it is a good practice to test full closure of the BOP with the drill pipe pulled above the BOP. These operations also test the seal of the wellhead connector to the subsea wellhead housing. While test tools are available, improvements are desired.

DISCLOSURE OF INVENTION

A test tool having a lower body, an upper mandrel, a ball valve and a bore is lowered on a string of drill pipe and inserted sealingly into a casing hanger bowl in a wellhead housing. The ball valve seats within a passage in the body and has an actuating mechanism located on one side. The actuating mechanism moves the ball valve between open and closed positions.

The ball valve is installed in the body in an open position to facilitate running of the test tool through the riser. In the first part of the test, the BOP clamps around the drill pipe to form a seal. Fluid is then pumped down a choke and kill line to test the ability of the BOP to seal around the pipe.

In the second part of the test, the operator rotates the drill string and mandrel, which closes the ball valve automatically. The rotation also disengages the body from the mandrel so that the drill pipe and mandrel may be lifted above the BOP. The BOP is then sealed in a closed position and fluid is once again pumped down the choke and kill line to test the seal.

After the second part of the test, the BOP is opened and the drill pipe and mandrel are once again lowered below the BOP. The mandrel reengages the body and is rotated, thereby opening the ball valve. The drill pipe, mandrel and body are then pulled upward to the surface.

BEST MODE FOR CARRYING OUT THE INVENTION

Figure 1:
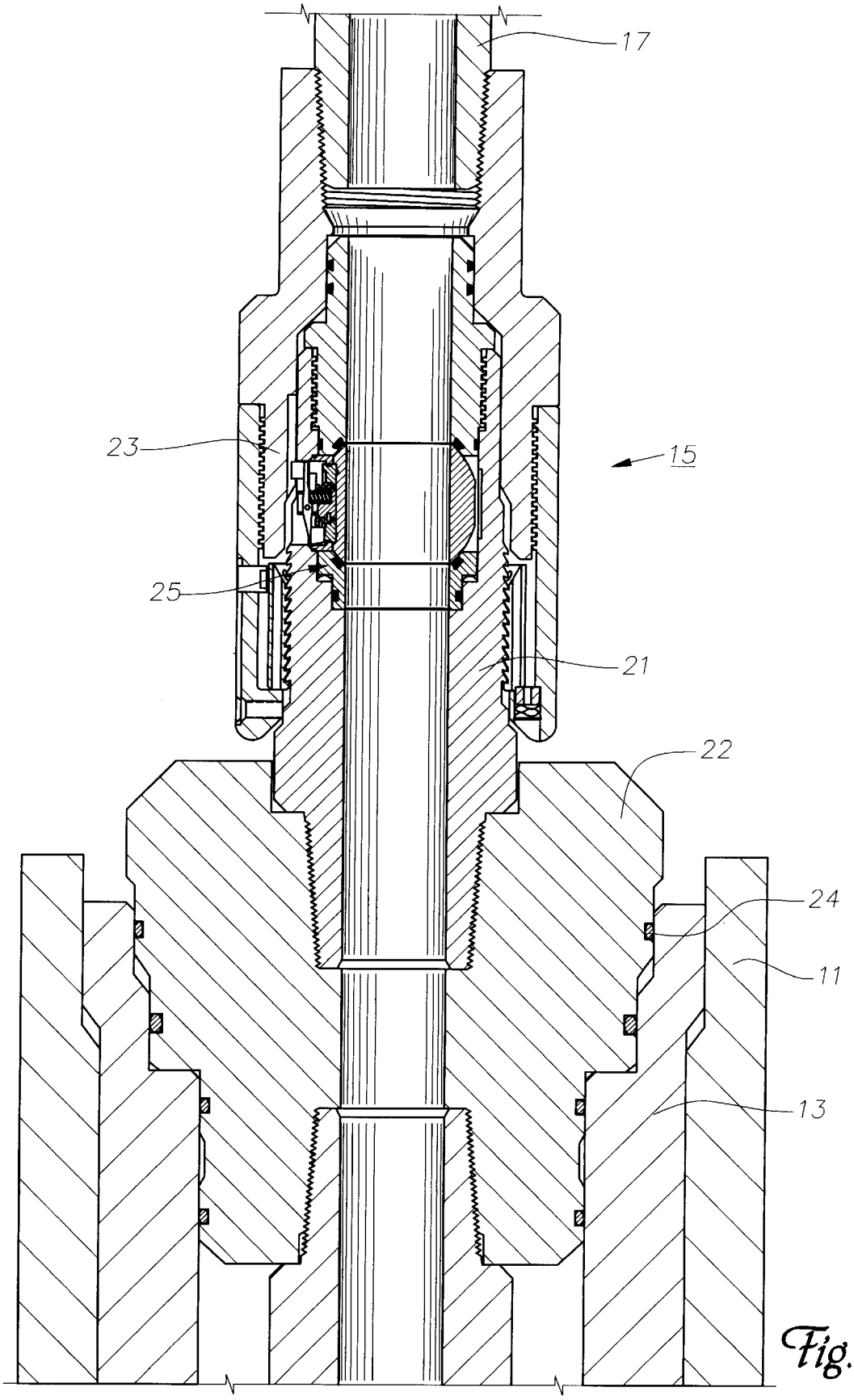
FIG. 1 is a sectional side view illustrating a well tool constructed in accordance with this invention, and showing the well tool in a sealed and locked position to the wellhead for testing.

Referring to FIG. 1, a wellhead housing 11 has a casing hanger 13 landed and sealed in it. Casing hanger 13 is part of the wellhead housing assembly. A test tool 15 is lowered on a string of drill pipe 17 and inserted sealingly into casing hanger 13. Test tool 15 has a lower tubular member or body 21, an upper tubular member or mandrel 23, a ball valve 25 and a bore 27. Body 21 has an enlarged lower portion 22 that will nest and seal in casing hanger 13 with seals 24.

Figure 2:
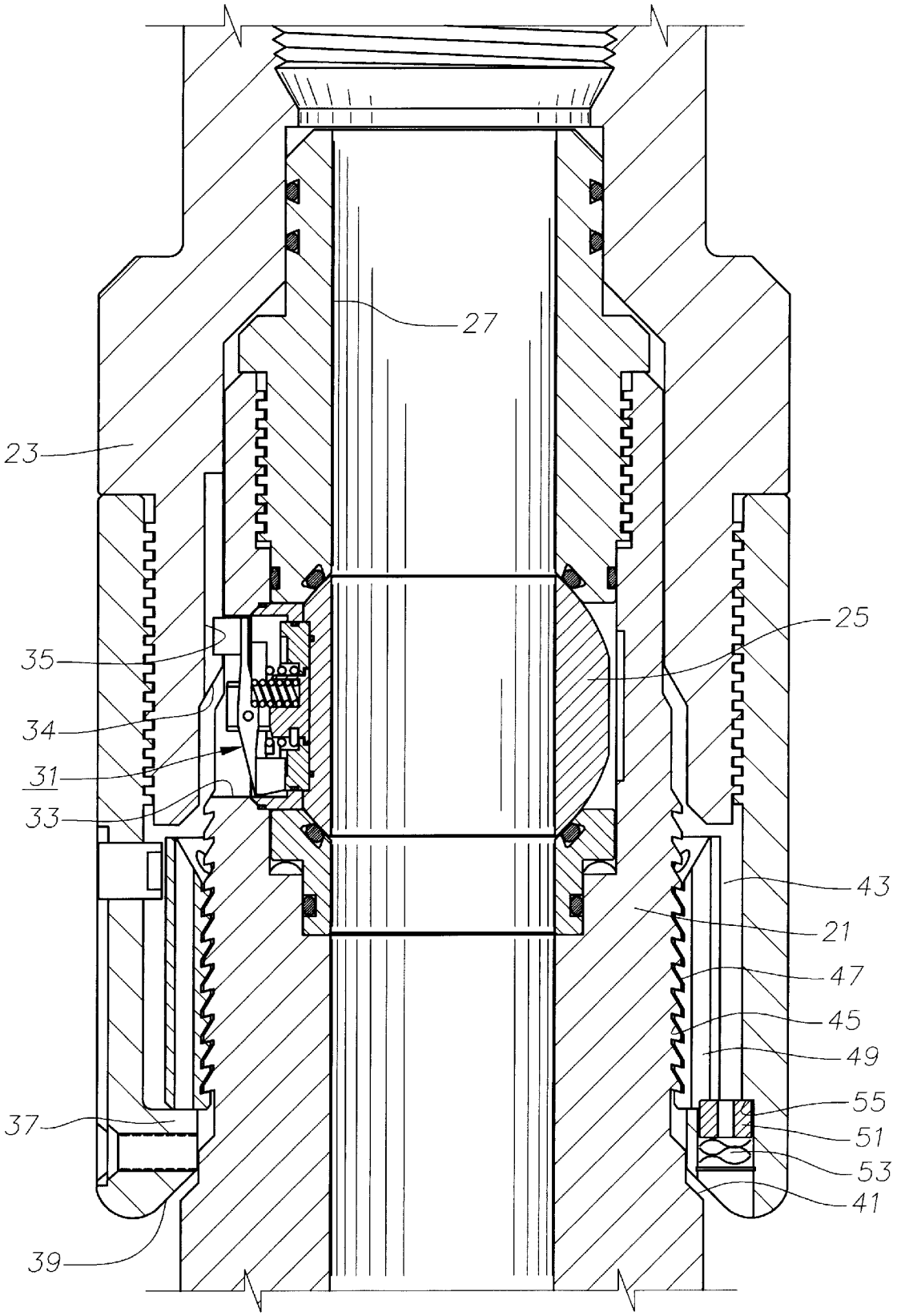
FIG. 2 is an enlarged sectional side view of the well tool of FIG. 1 showing the ball valve in the open position.

As shown in FIG. 2, ball valve 25 seats and seals within bore 27 of body 21. Ball valve 25 has an actuating mechanism 31 located on one side. Actuating mechanism 31 extends through a lateral opening 33 in body 21. Mandrel 23 has a center portion 34 with a vertical slot 35, an internal flange 37 and a downward-facing shoulder 39 that lands on an upward-facing shoulder 41 on body 21 to limit the downward movement of mandrel 23. A C-ring or retainer ring 43 having internal threads 45 is carried by mandrel 23 on flange 37. Threads 45 engage outer threads 47 on body 21. Retainer ring 43 has a vertical slot 49 which engages a tab 51 that is carried within flange 37. Tab 51 is urged upward by a spring 53 located between flange 37 and tab 51. The upward movement of tab 51 is limited by a stop shoulder 55. When slot 49 engages tab 51, retainer ring 43 and mandrel 23 will rotate together. When mandrel 23 moves downward a short distance relative to retainer ring 43, tab 51 disengages slot 49 and mandrel 23 can rotate relative to retainer ring 43.

Figure 3:
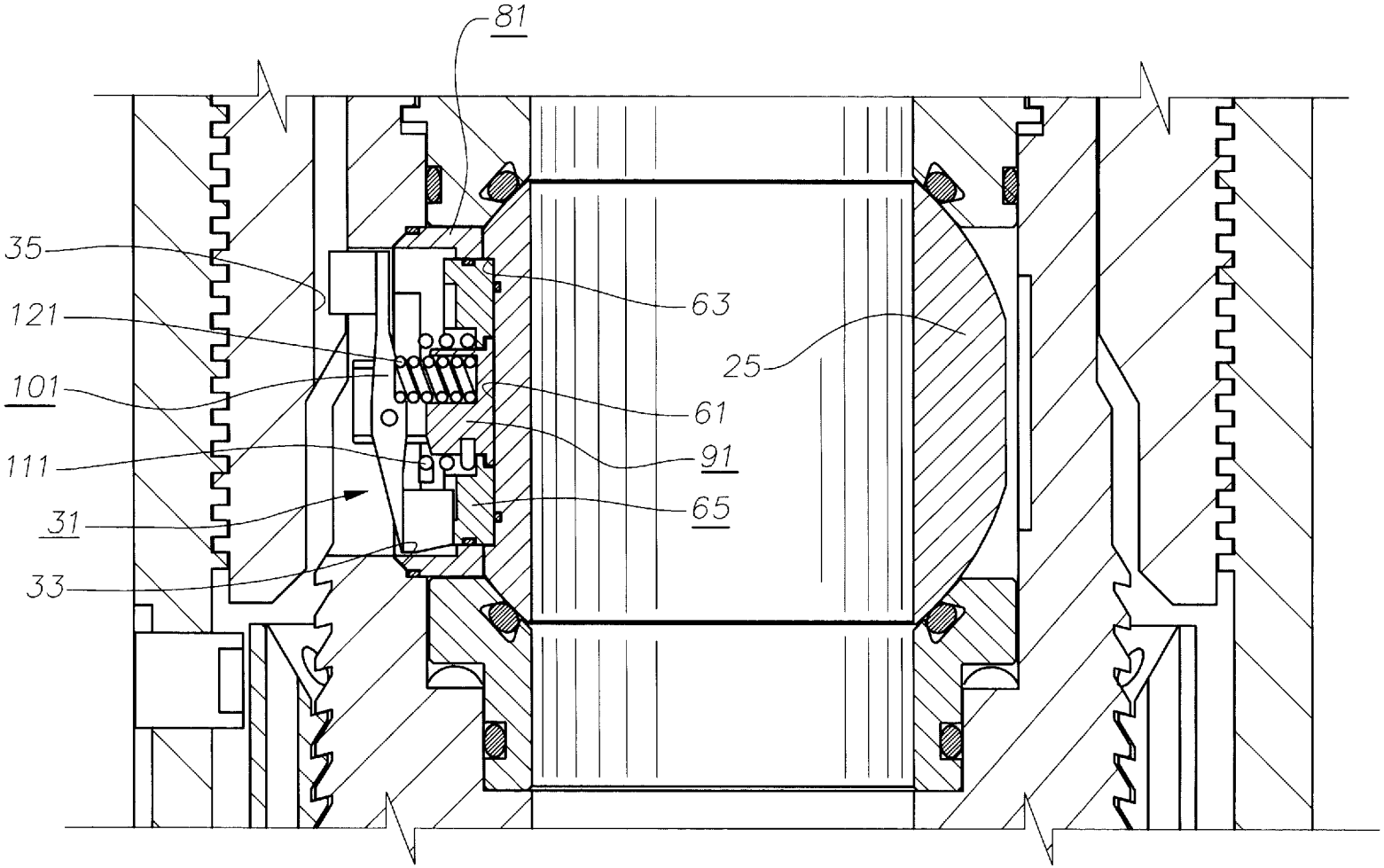
FIG. 3 is a further enlargement of the sectional side view of the well tool of FIG. 1.
Figure 4:
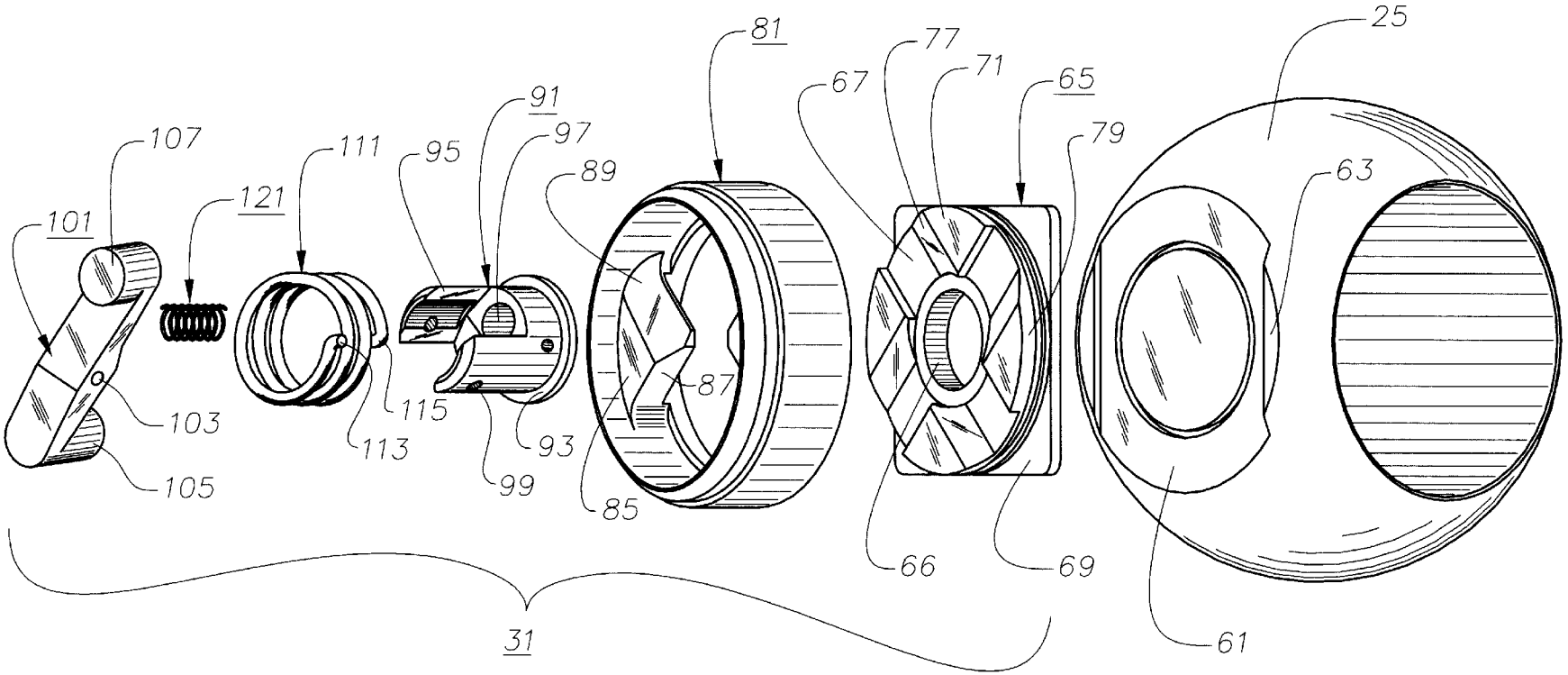
FIG. 4 is an exploded isometric view of the ball valve and the components of the actuating mechanism.

Referring to FIGS. 3 and 4, actuating mechanism 31 is provided to move ball valve 25 between open and closed positions. Ball valve 25 has a drive slot 61 which is used to couple with actuating mechanism 31. Drive slot 61 has two parallel drive walls 63 which closely receive a drive plate 65 so that there is no relative movement therebetween. Drive plate 65 has a cylindrical body 67 with a rectangular plate 69 on a rearward side and four raised wedges 71 on a forward side. The radially outer surface of body 67 is smooth. Wedges 71 are generally quarter-circular in shape and have a stop surface 75 on one edge and a ramp surface 77 on the other edge. The arcuate sides 79 of wedges 71 align with the circular portion of body 67. Drive plate 65 also has a central bore 66.

Figure 5:
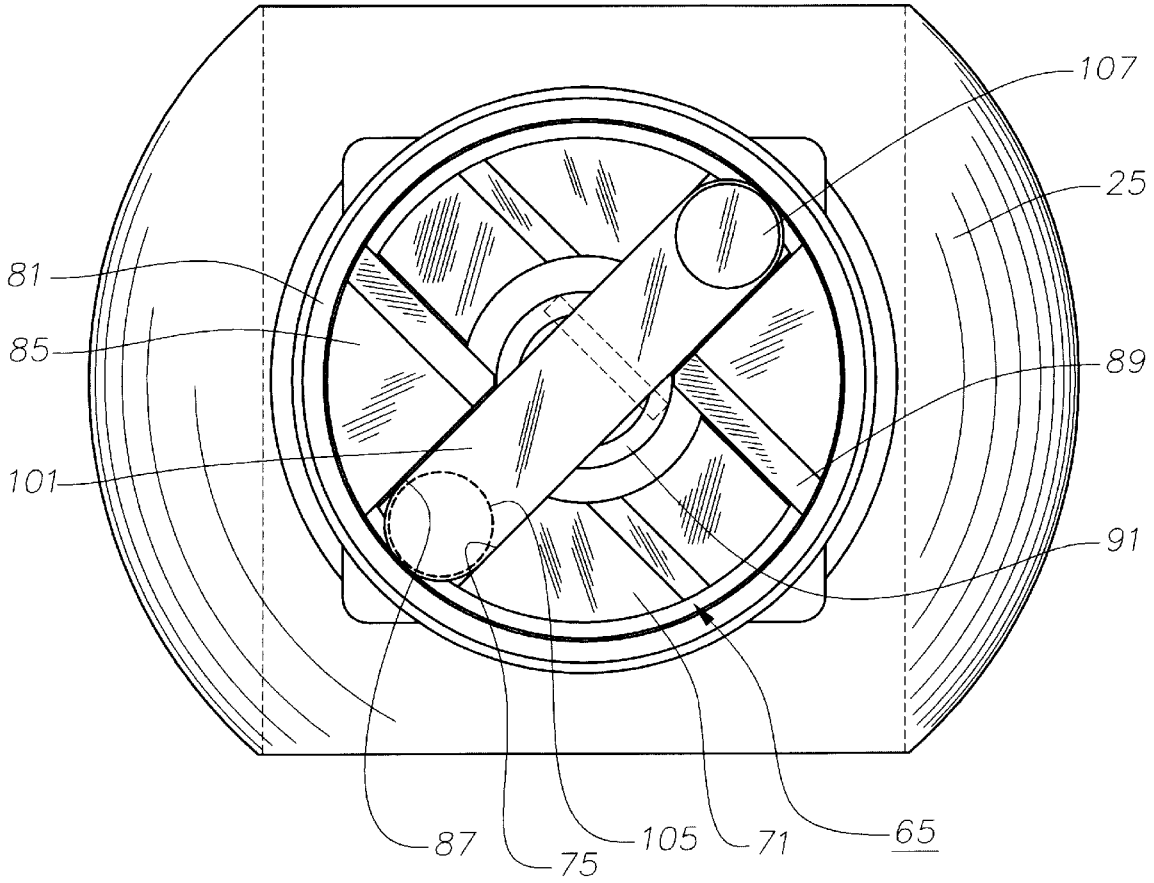
FIG. 5 is a front view of the ball valve in the open position and the rocker arm in a starting position.

A cylindrical clutch 81 has a smooth inner surface for sliding engagement with the radially outer surface of o cylindrical body 67. Clutch 81 and drive plate 65 are engaged such that drive plate 65 may rotate relative to clutch 81, but there is no axial movement therebetween. Clutch 81 is a cylindrical ring with two wedges 85 on its inner surface that are similar to wedges 71. Each wedge 85 has a stop surface 87 and a ramp surface 89 that are located opposite of stop surface 75 and ramp surface 77, respectively, on wedges 71. As shown in FIG. 5, wedges 71 on drive plate 65 are located in the three, six, nine and twelve o'clock positions. Wedges 85 on clutch 81 are located at the three and six o'clock positions. The outer cylindrical surface of clutch 81 is press-fit into opening 33 or otherwise secured in body 21 to prevent clutch 81 from moving relative to body 21.

Referring back to FIG. 4, a hub 91 is slidingly received by and extends through bore 66 in drive plate 65. Hub 91 has a flange 93 on a rearward end and two arcuate arms 95 on a forward end. Flange 93 rotatingly seats between drive plate 65 and drive slot 61. Flange 93 prevents axial movement of hub 91 relative to ball valve 25. Hub 91 will rotate relative to drive plate 65 and clutch 81.

A generally rectangular rocker arm 101 is closely received between arms 95 on hub 91. Rocker arm 101 is pivotally secured to hub 91 by a pin (not shown) which extends through holes 99 in arms 95 and through a hole 103 in rocker arm 101. Rocker arm 101 has a cylindrical inner finger 105 facing inward which engages drive plate 65. Rocker arm 101 also has a cylindrical outer finger 107 facing outward which engages slot 35 in mandrel 23. Fingers 105 and 107 are tapered or slightly conical such that their distal diameters are smaller than their proximal diameters.

A torsional spring 111 urges rocker arm 101 and hub 91 to rotate in a clockwise direction. Spring 111 has a tab 113 that lands on one side of rocker arm 101 and another tab 115 which lands on a stop surface 87 on clutch 81.

A compression spring 121 is used to pivotally urge outer finger 107 in a forward direction and inner finger 107 in a rearward direction. Spring 121 seats in a hole 97 in hub 91 on one end and applies compression force against a rearward surface of rocker arm 101 on the other end.

Figure 10:
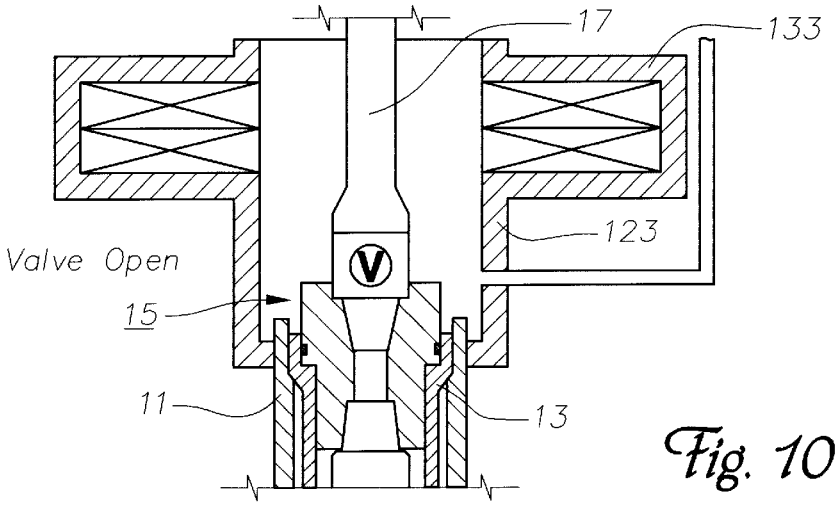
FIG. 10 is a schematic drawing of the well tool during installation.
Figure 11:
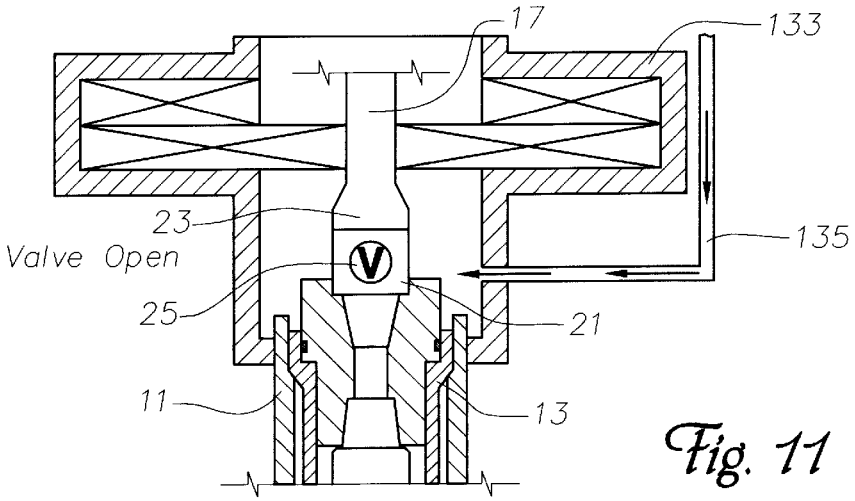
FIG. 11 is a schematic drawing of the well tool during testing of the BOP closing on the drill pipe.

In operation, ball valve 25 is installed in body 21 in an open position. As shown in FIG. 10, a riser 123 is secured to wellhead housing 11. Test tool 15 is lowered through riser 123 on a string of drill pipe 17 and sealed in casing hanger 13 below a blowout preventer or BOP 133. Referring to FIG. 11, BOP 133 clamps around drill pipe 17 to form a seal. Fluid is then pumped down a choke and kill line 135 to test the seal of BOP 133.

Full closure of BOP 133 may also be tested. First, mandrel 23 is picked up and rotated clockwise, as viewed from above. The rotation of mandrel 23 causes ball valve 25 to rotate to the closed position automatically. As mandrel 23 rotates, tab 55 engages slot 49 of retainer ring 43 (see FIG. 2) to force concurrent rotation of retainer ring 43. This causes retainer ring 43 to unscrew from and disengage body 21.

Before ball valve 25 is rotated to the closed position, rocker arm 101 is in a starting position wherein inner finger 105 rests against a stop surface 87 on clutch 81 (FIG. 5). As mandrel 23 (not shown in FIGS. 5–9) rotates and moves upward, slot 35 engages outer finger 107, thereby forcing rocker arm 101 to rotate with hub 91 in a counterclockwise direction. As rocker arm 101 rotates, inner finger 105 applies pressure to stop surface 75 to force drive plate 65 and ball valve 25 to rotate. Rocker arm 101, drive plate 65 and ball valve 25 continue to rotate for approximately 90 degrees until inner finger 105 strikes ramp surface 89 on clutch 81. Clutch 81 is rigidly secured to body 21 and is thus fixed from rotation. As shown in FIG. 7, ball valve 25 is now in the closed position.

Figure 6:
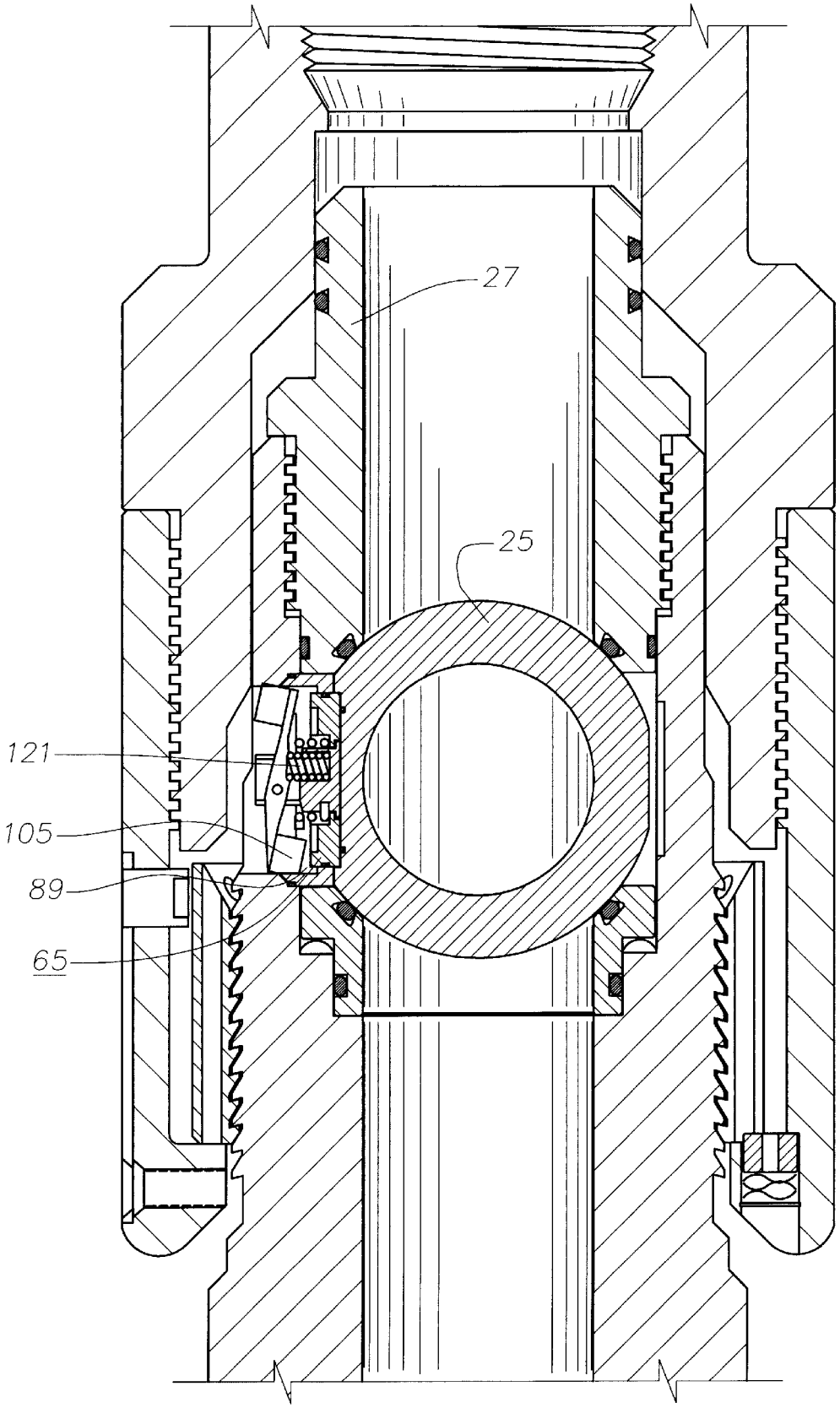
FIG. 6 is an enlarged sectional side view of the well tool of FIG. 2, showing the ball valve in the closed position.
Figure 7:
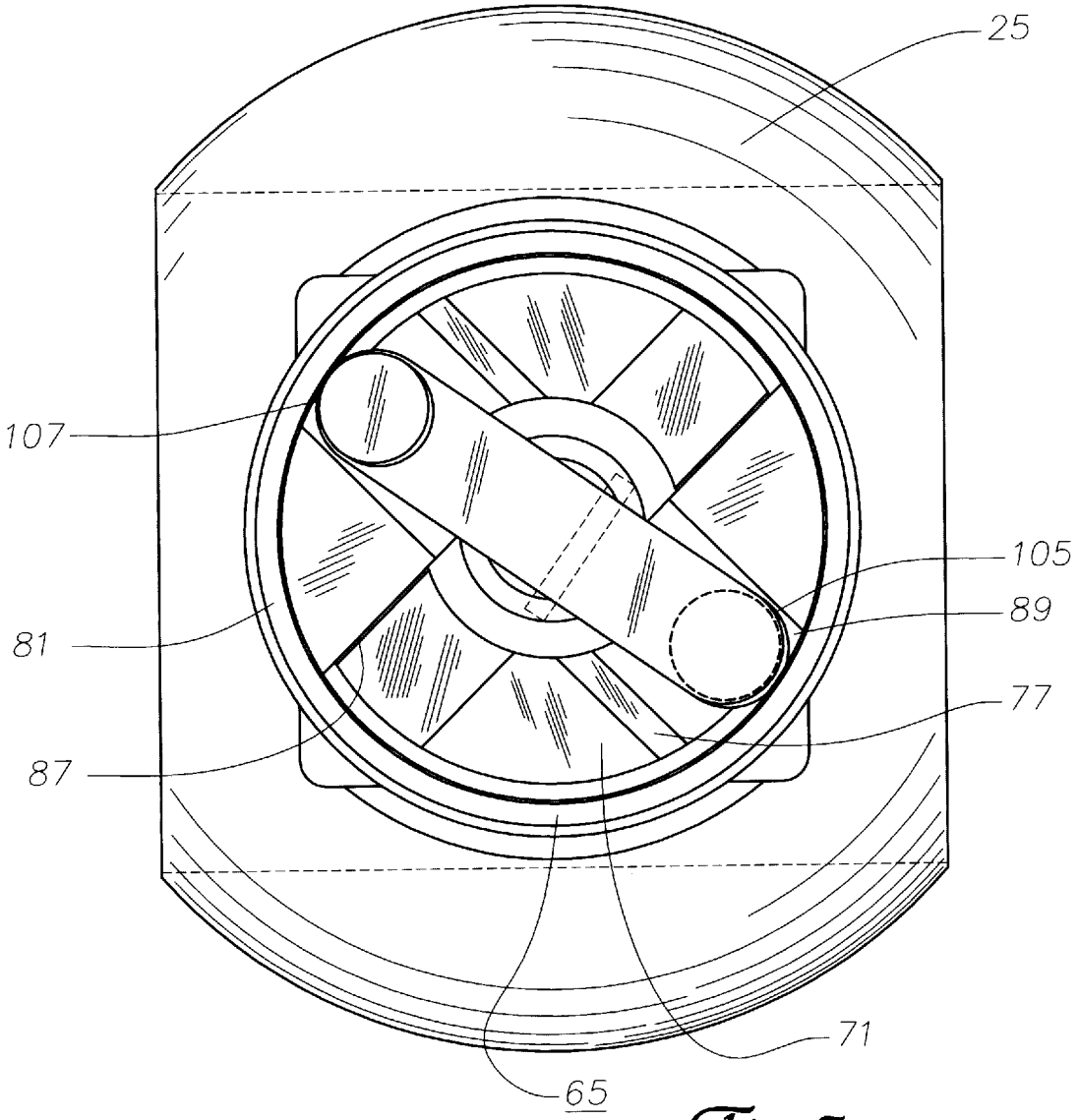
FIG. 7 is a front view of the ball valve in the closed position and the rocker arm fully rotated.
Figure 8:
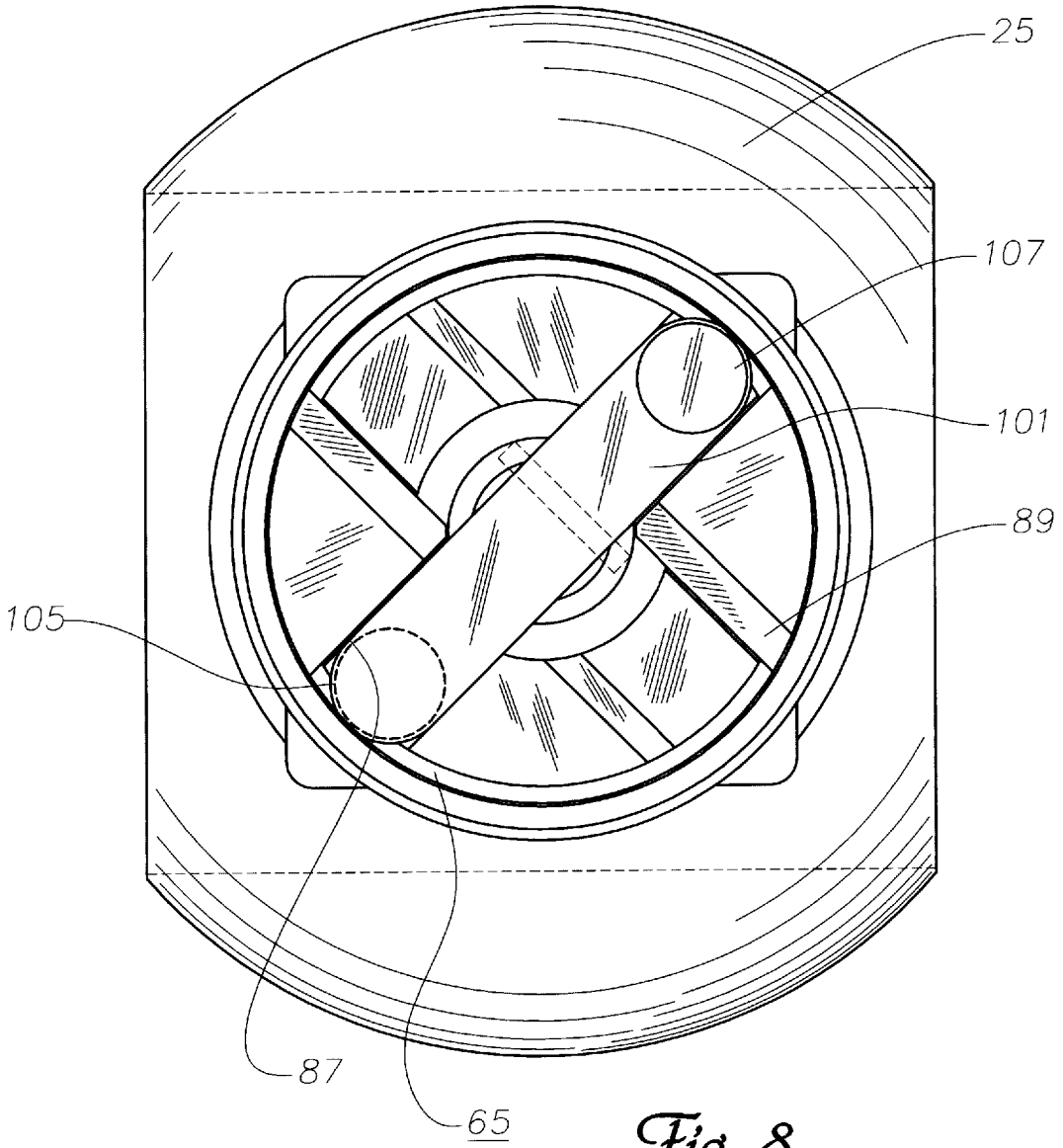
FIG. 8 is a front view of the ball valve in the closed position and the rocker arm in the starting position.
Figure 12:
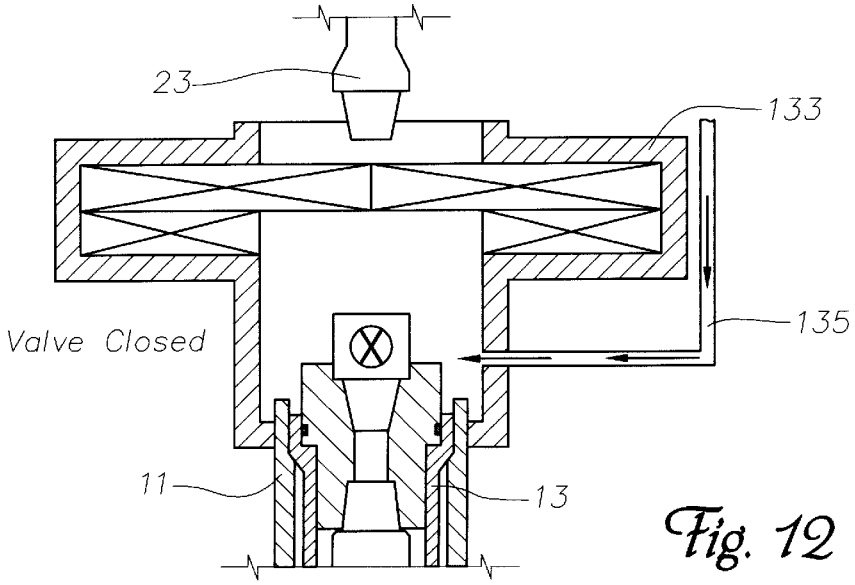
FIG. 12 is a schematic drawing of the well tool during testing of the BOP in full closure.

Referring to FIGS. 6 and 7, the tapered surface of inner finger 105 coupled with the incline on ramp surface 89 causes inner finger 105 to pivot in an outward direction, out of contact with drive plate 65. Outer finger 107 simultaneously moves inward and disengages slot 35. When mandrel 23 is raised out of engagement with outer finger 107, torsional spring 111 (not shown in FIGS. 5–9) forces rocker arm 101 to rotate in a clockwise direction toward its starting position. As rocker arm 101 rotates, inner finger 105 rides up ramp surface 77 and over wedge 71 in the six o'clock position on drive plate 65. Rocker arm 101 ceases rotation when inner finger 105 strikes stop surface 87 on clutch 81, thereby causing rocker arm 101 to stop in its starting position (FIG. 8). Compression spring 121 returns rocker arm 101 to an upright position, parallel to bore 27. As mandrel 23 continues to rotate, retainer ring 43 unthreads from body 21 so that mandrel 23 may be lifted above and separated from body 21 (FIG. 12). Mandrel 23 is lifted above BOP 133. BOP 133 is then moved to a closed position and fluid is once again pumped down choke and kill line 135 to test the seal.

After the full closure test, drill pipe 17 is lowered again. Mandrel 23 lands on body 21 with retainer ring 43 engaging body 21. Retainer ring 43 ratchets over and fully engages the threads on body 21 after stabbing mandrel 23 onto body 21.

Figure 9:
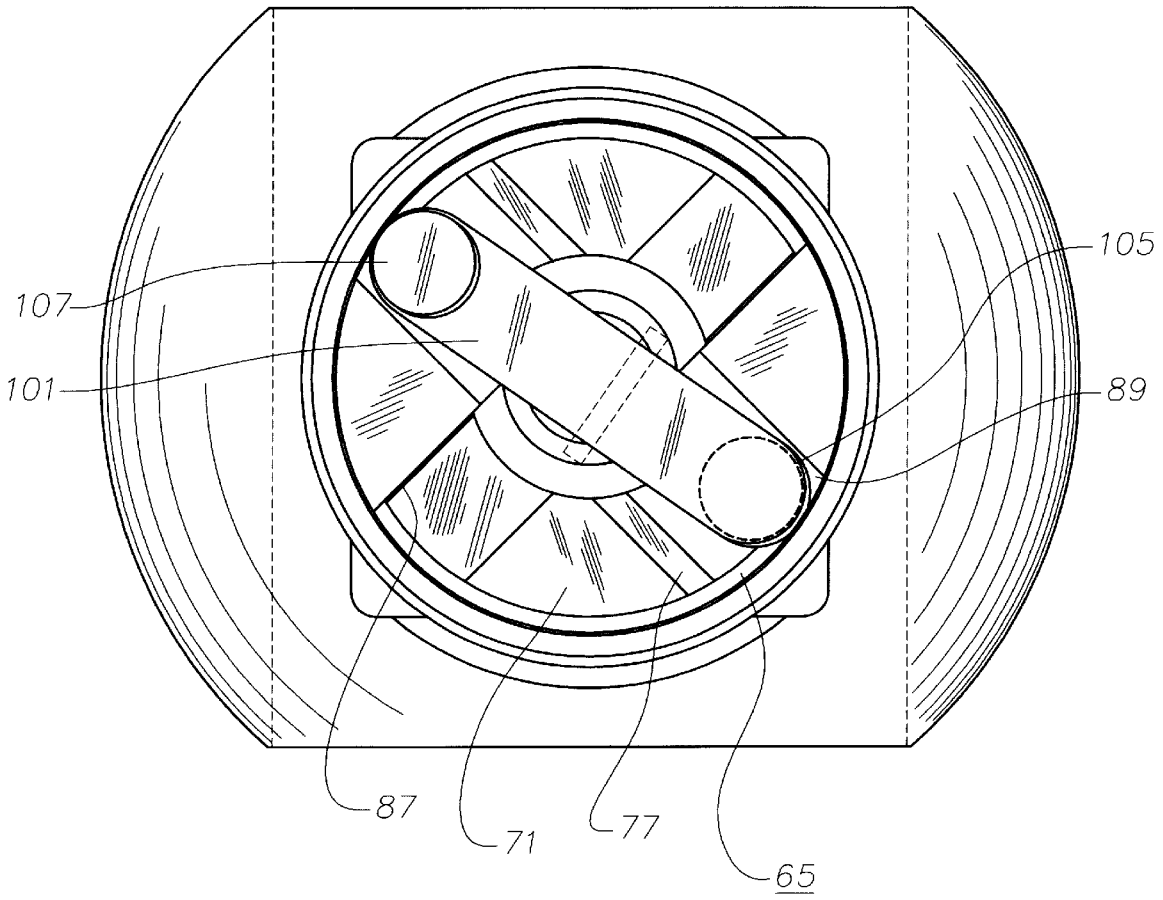
FIG. 9 is a front view of the ball valve in the open position and the rocker arm fully rotated.

As shown in FIG. 8, inner finger 105 rests against stop surface 87. Without picking up mandrel 23, the operator then rotates mandrel 23 which causes slot 35 to engage outer finger 107, thereby forcing inner finger 105 to rotate drive plate 65 and ball valve 25. Rocker arm 101, drive plate 65 and ball valve 25 continue to rotate for approximately 90 degrees until inner finger 105 strikes ramp surface 89 on clutch 81. Ball valve 25 is now again in the open position as shown in FIG. 9. The tapered surface of inner finger 105 coupled with the incline on ramp surface 89 causes inner finger 105 to pivot outward and out of contact with drive plate 65. Outer finger 107 simultaneously pivots inward and disengages slot 35. Because mandrel 23 was not lifted relative to body 21 during re-connection, tab 51 will be below retainer ring 43 and will not engage slot 49. Retainer ring 43, which has fully engaged the threads on body 21, does not rotate with mandrel 23 during the opening of ball valve 25. After ball valve 25 is opened, the entire test tool 15 is retrieved.

The invention has several advantages. The test tool allows a BOP to be tested both while closed on the drill pipe and also during full closure. The ball valve allows running-in of the test tool in an open position to fill the drill string. The ball valve automatically closes when the mandrel is picked up, leaving the body in the wellhead as a plug. By again opening the ball valve when re-engaging, the drill string is pulled upward when retrieving the test tool.

While the invention has been shown in only one of its forms, it should be apparent to those skilled in the art that it is not so limited, but is susceptible to various changes without departing from the scope of the invention.

I claim:

1. A well tool for testing a blowout preventer in a riser coupled to a wellhead housing assembly and extending upward to a drilling rig, comprising:

a lower tubular member selectively landed in the bore of the wellhead housing assembly, the lower tubular member having a passage therethrough;

a seal on the lower tubular member for sealing the lower tubular member in the bore;

an upper tubular member having a latched position in engagement with the lower tubular member and a released position released from the lower tubular member, the upper tubular member adapted to be connected to a string of pipe;

a valve mounted within the lower tubular member, the valve having a closed position for closing the passage in the lower tubular member and an open position; and actuating means for moving the valve from the open position to the closed position by manipulation of the upper tubular member relative to the lower tubular member with the pipe;

wherein, the blowout preventer may be tested by closing on the pipe while the upper tubular member is latched to the lower tubular member and applying pressure in the riser between the upper tubular member and the blowout preventer; and wherein the blowout preventer may be tested by manipulating the pipe and upper tubular member to close the valve, releasing the upper tubular member from the lower tubular member, pulling the upper tubular member above the blowout preventer, closing the blowout preventer to fully close the riser and applying pressure in the riser between the lower tubular member and the blowout preventer.

2. The well tool of claim 1 further comprising means for moving the upper tubular member from the latched position to the released position by rotating the upper tubular member relative to the lower tubular member.

3. The well tool of claim 1 further comprising a set of threads ring located between the upper tubular member and the lower tubular member for latching the upper tubular member to the lower tubular member and for releasing the upper tubular member from the lower tubular member by rotation of the upper tubular member relative to the lower tubular member.

4. The well tool of claim 1 wherein the actuating means comprises an arm in engagement with the upper tubular member and coupled to the valve for rotating the valve, the arm being rotated by the upper tubular member when the upper tubular member moves from the latched to the released position.

5. A well tool, comprising in combination:

an upper tubular member adapted to be connected to a string of conduit;

a lower tubular member having a passage therethrough;

a connector located between the upper tubular member and the lower tubular member, the connector having a latched position for engaging the upper tubular member to the lower tubular member, and the connector having a released position for allowing the upper tubular member to be lifted above the lower tubular member;

a ball valve mounted within the passage in the lower tubular member, the ball valve having a closed position and an open position; and actuating means in the upper tubular member and the lower tubular member rotationally operable in response to the upper tubular member moving to the released position for simultaneously moving the ball valve from the open position to the closed position.

6. The well tool of claim 5 wherein the actuating means has means for moving the ball valve from the closed position back to the open position when the upper tubular member is lowered back into engagement.

7. The well tool of claim 5 wherein the actuating means comprises an arm coupled to the ball valve for rotating the ball valve, the arm being rotated by the upper tubular member when the upper tubular member moves from the latched position to the released position.

8. The well tool of claim 7, further comprising means for limiting the arm to 90 degrees of rotation.

9. A well tool, comprising in combination:

an upper tubular member adapted to be connected to a string of conduit;

a lower tubular member having a passage therethrouqh;

a connector located between the upper tubular member and the lower tubular member, the connector having a latched position for engaging the upper tubular member to the lower tubular member, and the connector having a released position for allowing the upper tubular member to be lifted above the lower tubular member;

a ball valve mounted within the passage in the lower tubular member, the ball valve having a closed position and an open position;

actuating means in the upper tubular member and the lower tubular member operable in response to the upper tubular member moving to the released position for simultaneously moving the ball valve from the open position to the closed position; and wherein the connector has means for moving from the latched position to the released position by rotating the upper tubular member relative to the lower tubular member.

10. A well tool, comprising in combination:

an upper tubular member adapted to be connected to a string of conduit;

a lower tubular member having a passage therethrouqh;

a connector located between the upper tubular member and the lower tubular member, the connector having a latched position for engaging the upper tubular member to the lower tubular member, and the connector having a released position for allowing the upper tubular member to be lifted above the lower tubular member;

a ball valve mounted within the passage in the lower tubular member, the ball valve having a closed position and an open position;

actuating means in the upper tubular member and the lower tubular member operable in response to the upper tubular member moving to the released position for simultaneously moving the ball valve from the open position to the closed position; wherein the connector comprises a split retainer ring;

an inner surface of the retainer ring is threaded; and the lower tubular member has an outer threaded surface which is engaged by the inner surface of the retainer ring, enabling the upper tubular member to be released by rotating the retainer ring and upper tubular member relative to the lower tubular member and enabling re-engagement of the upper tubular member with the lower tubular member by downward, straight axial movement of the upper tubular member onto the lower tubular member.

11. A well tool, comprising in combination:

an upper tubular member adapted to be connected to a string of conduit;

a lower tubular member having a passage therethrouqh;

a split retainer ring located between the upper tubular member and the lower tubular member, the retainer ring having a latched position for engaging the upper tubular member to the lower tubular member, and the retainer ring having a released position for allowing the upper tubular member to be lifted above the lower tubular member;

a ball valve mounted within the passage in the lower tubular member, the ball valve having a closed position and an open position;

actuating means in the upper tubular member and the lower tubular member operable in response to the upper tubular member moving to the released position for simultaneously moving the ball valve from the open position to the closed position; and tab means for selectively allowing the upper tubular member to rotate relative to a retainer ring after reengagement to open the ball valve.

12. A well tool, comprising in combination:

an upper tubular member having a bore and a slot in the bore, the upper tubular member being adapted to be connected to a string of conduit;

a lower tubular member carried by the upper tubular member and having a passage therethrough, the upper tubular member being rotatable relative to the lower tubular member and being releasable from the lower tubular member in response to rotation;

a ball valve mounted within the passage in the lower tubular member;

a drive member mounted to the ball valve for rotating the ball valve from an open position to a closed position;

an arm coupled to the drive member, the arm engaging the slot in the upper tubular member so that rotation of he upper tubular member relative to the lower tubular member rotates the arm and thus the drive member and the ball valve; and a clutch between the arm and the drive member for releasing the arm from the slot after the ball valve has rotated to the closed position.

13. The well tool of claim 12 wherein the lower tubular member has a threaded outer surface, and wherein the well tool further comprises:

a split retainer ring having a threaded inner surface for engaging the outer surface on the lower tubular member, enabling the upper tubular member to be released by rotating the retainer ring and the upper tubular member relative to the lower tubular member and enabling re-engagement of the upper tubular member with the lower tubular member by downward, straight axial L movement of the upper tubular member onto the lower tubular member.

14. The well tool of claim 12, further comprising return means for returning the arm to a starting position after the arm has rotated the ball valve from the open position to the closed position.

15. The well tool of claim 12, further comprising means for limiting the ball valve to rotation in one direction.

16. A well tool, comprising:

an upper tubular member having a bore with a longitudinal axis and a slot in the bore, the upper tubular member being adapted to be connected to a string of conduit;

a lower tubular member carried by the upper tubular member and having a passage therethrough;

a split retainer ring having a threaded inner surface for engaging a threaded outer surface on the lower tubular member, enabling the upper tubular member to be released from the lower tubular member by rotating the retainer ring and the upper tubular member relative to the lower tubular member, and enabling re-engagement of the upper tubular member with the lower tubular member by downward, straight axial movement of the upper tubular member onto the lower tubular member;

a ball valve mounted within the lower tubular member, the ball valve being rotatable about a lateral axis which is perpendicular to the longitudinal axis between an open position and a closed position;

a drive plate mounted to and rotatable with the ball valve relative to the lower tubular member, the drive plate having at least one drive shoulder;

a hub rotatably mounted to the drive plate, the hub extending outward from the drive plate along the lateral axis;

a rocker arm pivotally mounted to the hub, the rocker arm having an inner finger on one end and an outer finger on another end, the outer finger engaging the slot in the upper tubular member when in a starting position, such that rotation of the upper tubular member relative to the lower tubular member about the longitudinal axis rotates the rocker arm about the lateral axis toward a final position which in turn causes the inner finger to engage the drive shoulder and rotate the ball valve about the lateral axis toward the closed position;

a clutch stationarily mounted between the rocker arm and the drive plate, the clutch having at least one ramp surface which is engageable by the inner finger when the rocker arm reaches the final position, the ramp surface pivoting the inner finger outward, thereby releasing the inner finger from engagement with the drive shoulder after the ball valve is rotated to the closed position; and wherein when the inner finger is pivoted outward, the outer finger is pivoted inward and disengages from the slot in the upper tubular member.

17. The well tool of claim 16, further comprising a torsional spring secured to the hub, the torsional spring urging the rocker arm to rotate to the starting position; and wherein the clutch further comprises:

at least one stop shoulder for limiting the rotation of the rocker arm to the starting position after the inner finger has disengaged from the slot.

18. The well tool of claim 16, further comprising a compression spring located between the hub and the upper end of the rocker arm, the compression spring urging the outer finger of the rocker arm to pivot outward.

19. The well tool of claim 16, further comprising a tab on the upper tubular member for engaging the retainer ring with the upper tubular member for rotation therewith by moving the upper tubular member upward relative to the retainer ring, and for disengaging the retainer ring from rotation with the upper tubular member upon re-engagement of the upper tubular member with the lower tubular member to reopen the ball valve.

20. A method for testing a blowout preventer with a wellhead assembly having a wellhead housing assembly containing a bore, a riser coupled to the wellhead housing assembly and extending upward to a drilling rig, the blowout preventer being mounted in the riser, comprising:

connecting a string of pipe to an upper tubular member having a latched position in engagement with a lower tubular member which has a passage therethrough and a released position released from the lower tubular member;

mounting a valve within the passage in the lower tubular member, the valve having a closed position and an open position;

landing and sealing the lower tubular member in the bore of the wellhead housing assembly;

closing the blowout preventer around the pipe and applying pressure in the riser between the blowout preventer and the lower tubular member to test the blowout preventer;

moving the valve from the open position to the closed position by manipulation of the upper tubular member relative to the lower tubular member with the pipe; and releasing the upper tubular member from the lower tubular member and pulling the upper tubular member above the blowout preventer; then closing the blowout preventer and applying pressure in the riser between the lower tubular member and the blowout preventer to test full closure of the blowout preventer.

21. The method of claim 20, further comprising:

re-engaging the lower tubular member with the upper tubular member;

moving the valve from the closed position to the open position by manipulation of the upper tubular member relative to the lower tubular member with the pipe; then lifting the lower tubular member out of the bore of the wellhead housing assembly with the upper tubular member.

* * * * *